US006898879B2

(12) United States Patent
Regelin

(10) Patent No.: US 6,898,879 B2
(45) Date of Patent: May 31, 2005

(54) MEMORY MARKER FOR A GRAVESITE

(76) Inventor: Larry Regelin, 14300 Orchard Rd., Minnetonka, MN (US) 55435

( * ) Notice: Subject to any disclaimer, the term of this patent is extended or adjusted under 35 U.S.C. 154(b) by 0 days.

(21) Appl. No.: 10/632,161

(22) Filed: Aug. 1, 2003

(65) Prior Publication Data

US 2005/0022433 A1 Feb. 3, 2005

(51) Int. Cl.[7] ..... G09F 1/00; E01F 9/011
(52) U.S. Cl. ..... 40/124.5; 52/103
(58) Field of Search ..... 40/124.5; 52/103

(56) References Cited

U.S. PATENT DOCUMENTS 1,904,738 A * 4/1933 Johnson ..... 40/124.5
4,259,803 A 4/1981 Sittler
4,736,538 A * 4/1988 Pierce et al. ..... 40/779
4,761,903 A 8/1988 Cantrell
4,771,560 A 9/1988 Richards
4,790,088 A * 12/1988 Morvant ..... 40/124.5
4,939,877 A 7/1990 Claffey
5,307,574 A 5/1994 Huff, Jr.
6,094,871 A * 8/2000 Arnold et al. ..... 52/103
D436,135 S 1/2001 Emert

* cited by examiner

*Primary Examiner*—S. Joseph Morano
*Assistant Examiner*—Robert J. McCarry, Jr.

(57) ABSTRACT

A gravesite memory marker made of transparent flexibly resilient plastic having a pair of nestable members forming a weather resistant framed area for holding a photograph or other memorabilia and a pointed stake for insertion into the ground at the gravesite.

14 Claims, 3 Drawing Sheets

MEMORY MARKER FOR A GRAVESITE

FIELD OF THE INVENTION

This invention is aimed at providing a durable marker for installation in the ground adjacent a grave site for holding a photograph or other memorabilia in memory of the deceased. More specifically, it is a marker made out of flexibly resilient clear polymer plastic with the photograph or the like secured in a framed area between two similar nested members.

BACKGROUND OF THE INVENTION

There are a number of prior art devices for holding photographs and the like in the form of ordinary picture frames and there are a number of prior art devices for placing signs, such as real estate signs or outdoor sale sign, upright using a stake or post inserted into the ground. These devices usually are made out of a combination of different materials. Some have members or attachments to protect the sign against weather elements and some are constructed so that the content of the sign can be changed from time to time.

SUMMARY OF THE INVENTION

A pair of substantially similar nestable members are made out of flexibly resilient transparent plastic such as PVC, each member having a fairly shallow cavity defined by a generally planar floor surrounded by an enclosing wall. The floor has a slight indentation which is dimensioned with respect to the surrounding wall to define a framed area for a photograph or the like. One member is nested snugly within the cavity of the other member with the respective bottom walls in close proximity to securely hold the photograph in place between them within the framed area. A pointed stake extends out from an edge of one of the members for insertion into the ground to hold the marker upright at the gravesite. In addition, a flange may be provided which extends completely around each of the members extending outward from the walls which surround the cavities. The flange in combination with the nested members helps to seal off the interior area where the photograph is contained to protect it against damage from the weather. The two members can be disengaged or pulled apart if desired to remove and/or replace the photograph and then recoupled together.

In a preferred embodiment the members and the stake are made integral with one another as a single sheet of plastic with the two members joined together along an edge by a living hinge. Alternatively, the two members may be separate from one another.

DESCRIPTION OF THE PREFERRED EMBODIMENTS

Figure 1:
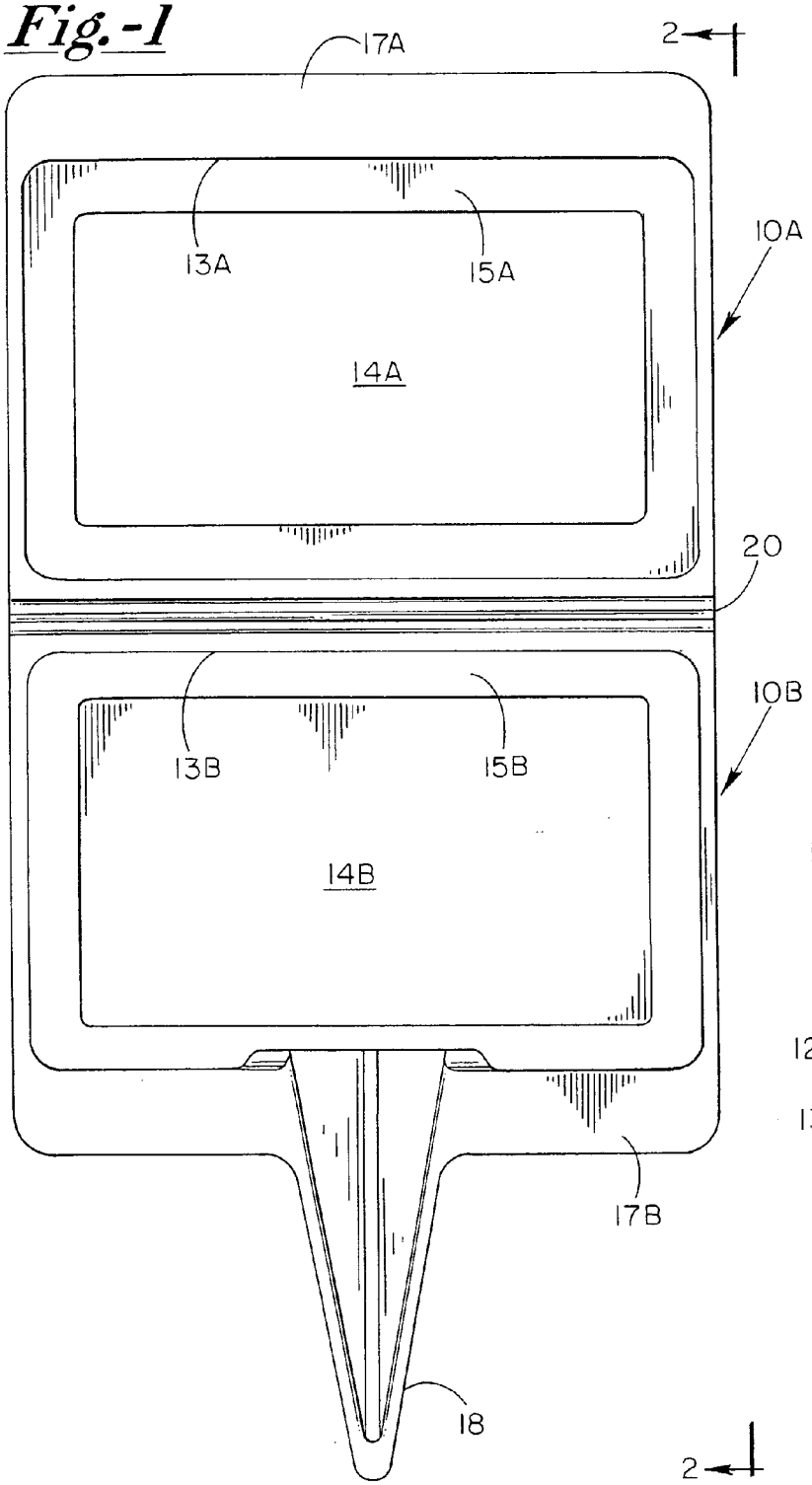
FIG. 1 can be considered a plan or front view of an embodiment of the invention in the open condition.
Figure 2:
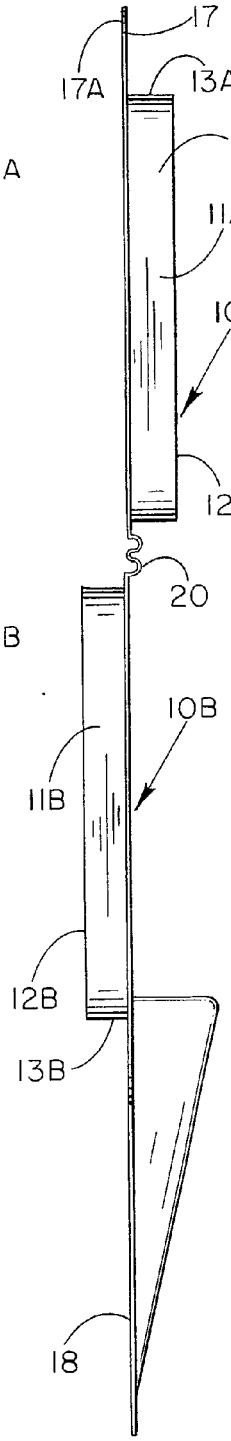
FIG. 2 is a side view of FIG. 1.
Figure 3:
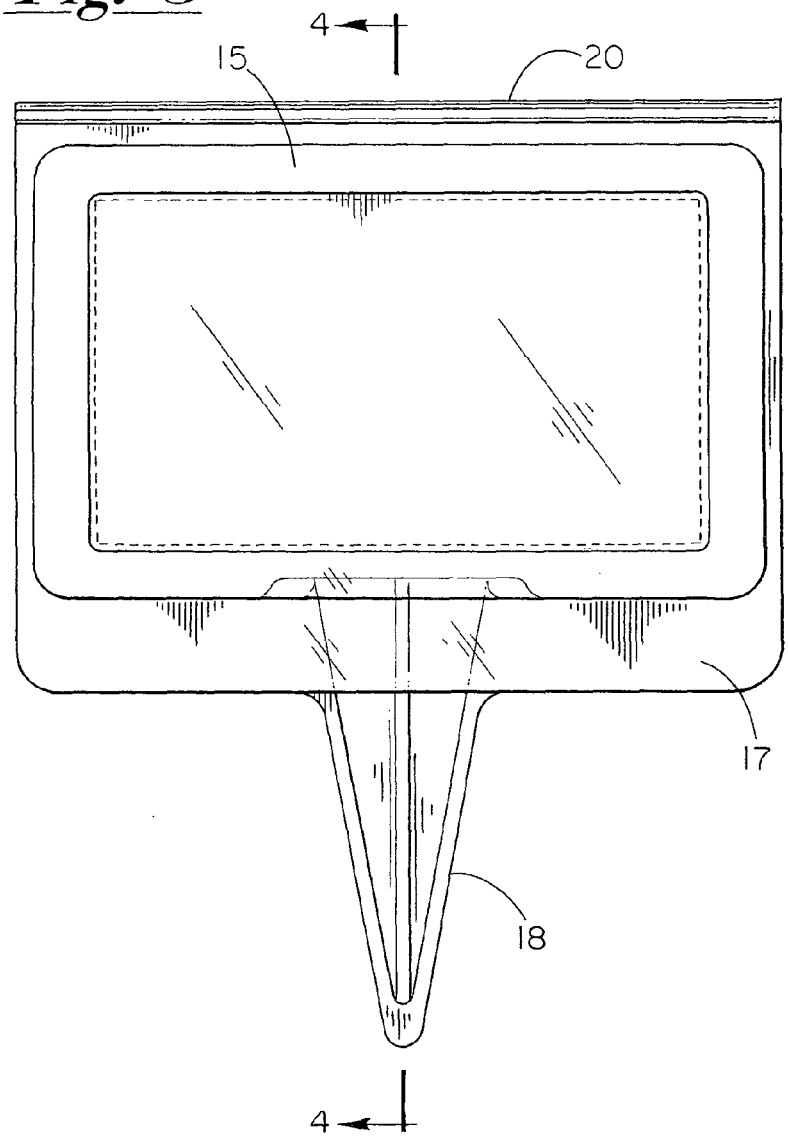
FIG. 3 is a plan or front view showing an embodiment of the invention in closed or use position.
Figure 4:
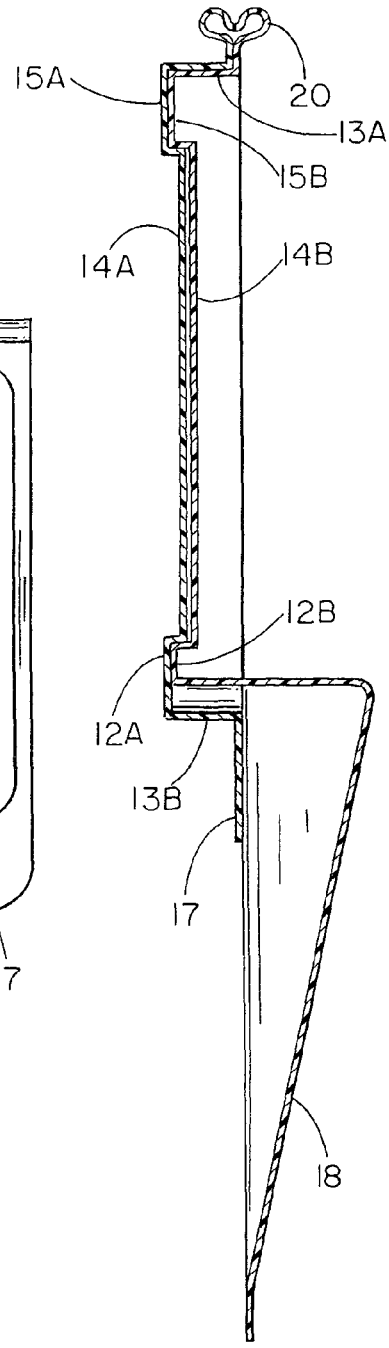
FIG. 4 is a sectioned view of FIG. 3.

A pair of substantially similar members 10A and 10B are formed of flexibly resilient transparent polymer plastic such as PVC by a conventional thermo-forming process. Each of the members has a cavity, 11A and 11B, respectively, defined by a generally planar bottom or floor 12A and 12B, respectively, surrounded by an upstanding wall 13A and 13B, respectively. The respective cavity floors 12A and 12B each has a very slight outer indentation 14A and 14B, respectively, with the outer edges of the indentations defining a frame area 15A and 15B, respectively, with their corresponding cavities' surrounding walls 13A and 13B. Extending outward from each of the respective surrounding walls parallel to the cavity floor are enclosing flanges 17A and 17B, respectively. Attached to and formed integrally with an edge of one of the members, for example, 10B, is a pointed arrow-like stake 18. In one embodiment, illustrated in FIGS. 1–4, members 10A and 10B are joined together by an integrally formed living hinge 20 at an edge of the respective flanges.

In practice, a photograph or other similar flat or planer memorabilia is placed in the depression area 14 of one of the members, for example 14B, and the other member 10A is swung about living hinge 20 over member 10B to nest member 10B into cavity 11A. The members are dimensioned and the materials of which they are made are such that member 10A will nest snugly in cavity 11B to hold the photograph or the like firmly between the two floors 12A and 12B in the framed areas 14. The snug fit between the side walls 13A and 13B not only serve to hold the photograph firmly in place within the framed area but also provide a secure protective shield against weather elements. In addition the overlap of the flanges 17A and 17B serve as a further seal against outside weather elements reaching the interior location of the framed photograph. The stake 18 is inserted into the ground adjacent the gravesite to hold the marker upright in place. If desired, the marker can be removed from the ground and the two members 10A and 10B disengaged or pulled apart and the photograph removed and replaced in the same manner as described above.

Typically, with no limitation intended, a marker made according to the teachings of the invention is made of 0.030 in. clear PVC, an outer width (including flange 17) of about 6.25 in., a depth of cavity 11 about 0.38 in., the width of the frame 15 about 0.5 in., the depth of the shallow indentation about 0.08 in. and the dimension of the framed area about 3 in. by 5 in. to hold a conventional 3×5 photograph.

Figure 5:
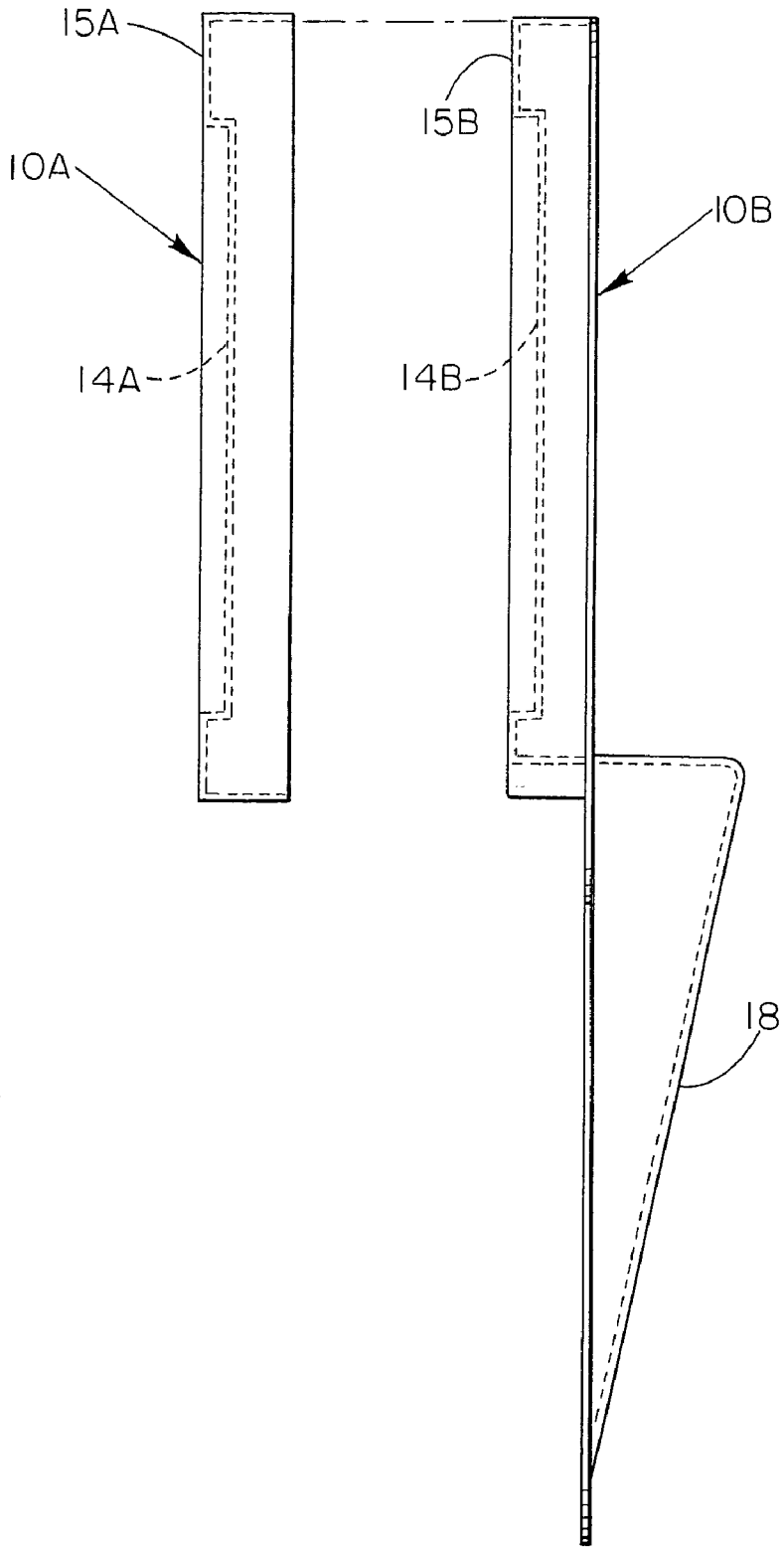
FIG. 5 is a side view illustrating another embodiment of the invention.

Alternatively, the two members 10A and 10B, may be formed of the same material but not connected by a living hinge, as illustrated in FIG. 5. In all other respects the marker is identical to the above-described embodiment and functions the same and is used in the same manner with the same attendant benefits and features.

I claim:

1. A memory marker for a gravesite comprising:

a layer of flexibly resilient transparent plastic formed into a pair of substantially similar members, each member having a cavity defined by a generally planar bottom surrounded by a wall, each bottom having a shallow outer indentation defining a frame between the edges of the indentation and the surrounding wall;

a living hinge attaching an edge of one member to an edge of the other member;

one member swingable about said living hinge for removable snug nesting into the cavity of the other member for holding indicia between said planar bottoms within said frame; and means attached to at least one of said members for insertion into the ground at a gravesite.

2. The memory marker for a gravesite as described in claim 1 further including a flange extending outward from the wall of each member, said flanges overlapping to form a seal against outside weather elements when said one member is nested into the cavity of the other member.

3. The memory marker for a gravesite as described in claim 1 wherein said means for insertion into the ground is a stake.

4. The memory marker for a graveside as described in claim 3 wherein said stake is integrally formed out of the sheet of plastic.

5. The memory marker for a gravesite as described in claim 1 wherein said members are generally rectangular.

6. A memory marker for a gravesite, comprising:

a pair of substantially similar members, each made of transparent flexibly resilient plastic, each member having a cavity defined by a planar bottom surrounded by a wall;

a bottom of at least one of said cavities having an outer shallow indentation defining a frame with said wall;

said members dimensioned such that one of the members is snugly removably nestable into the cavity of the other member for securely holding selected indicia between said bottoms within said frame; and means attached to at least one of the members for insertion into the ground adjacent a gravesite.

7. The memory marker for a gravesite as described in claim 6 further including a flange extending outward from the wall of each member, said flanges overlapping to seal against weather elements when one member is nested into the other member.

8. The memory marker for a gravesite as described in claim 7 wherein said means for insertion into the ground is a stake.

9. A memory marker for a gravesite as described in claim 8 wherein said stake is integrally formed with one of said members.

10. A memory marker for a gravesite as described in claim 6 wherein said members are integrally formed with a living hinge attaching one member to the other member at adjacent edges of their respective flanges.

11. A memory marker for a gravesite as described in claim 6 wherein said members are separate.

12. The memory marker for a gravesite as described in claim 10 further including a flange extending outward from the wall of each member, said flanges overlapping to seal against weather elements when one member is nested into the other member.

13. The memory marker for a gravesite as described in claim 11 further including a flange extending outward from the wall of each member, said flanges overlapping to seal against weather elements when one member is nested into the other member.

14. The memory marker as described in claim 1 or 6 wherein the cavity walls snugly fit together to form a shield against weather elements when said members are nested.

* * * * *